US007369021B2

(12) United States Patent
Bogdon et al.

(10) Patent No.: US 7,369,021 B2
(45) Date of Patent: May 6, 2008

(54) UNDERVOLTAGE RELEASE AND CIRCUIT BREAKER INCORPORATING SAME

(75) Inventors: Erik R. Bogdon, Carnegie, PA (US); Dominic P. Martelli, McKees Rocks, PA (US); James A. Trax, Oakdale, PA (US); Craig A. Rodgers, Butler, PA (US)

(73) Assignee: Eaton Corporation, Cleveland, OH (US)

( * ) Notice: Subject to any disclaimer, the term of this patent is extended or adjusted under 35 U.S.C. 154(b) by 455 days.

(21) Appl. No.: 11/219,113

(22) Filed: Sep. 2, 2005

(65) Prior Publication Data

US 2006/0071740 A1 Apr. 6, 2006

Related U.S. Application Data

(60) Provisional application No. 60/615,095, filed on Oct. 1, 2004.

(51) Int. Cl.
*H01F 83/00* (2006.01)

(52) U.S. Cl. ..... 335/6; 335/20

(58) Field of Classification Search ..... 335/6, 335/20, 21, 172–174
See application file for complete search history.

(56) References Cited

U.S. PATENT DOCUMENTS

| | | | | |
|---|---|---|---|---|
| 5,093,643 | A * | 3/1992 | Altenhof et al. | 335/20 |
| 5,444,424 | A | 8/1995 | Wong et al. | |
| 5,726,614 | A | 3/1998 | Castonguay et al. | |
| 6,201,460 | B1 * | 3/2001 | Winslett et al. | 335/172 |
| 6,232,855 | B1 | 5/2001 | Malingowski et al. | |
| 6,255,924 | B1 | 7/2001 | Turner et al. | |
| 6,903,635 | B2 * | 6/2005 | Brignoni et al. | 335/6 |

* cited by examiner

*Primary Examiner*—Ramon M. Barrera
(74) *Attorney, Agent, or Firm*—Martin J. Moran

(57) ABSTRACT

The reset lever on a circuit breaker undervoltage relay is actuated by translating arcuate movement of a handle arm pin as the circuit breaker handle is moved to the off position into rotation of the reset lever through a complaint interface lever that is stiff enough to actuate the reset lever, but flexible enough to accommodate for overtravel of the handle arm pin when the circuit breaker is reset and for the stackup of tolerances in the operating mechanism.

20 Claims, 5 Drawing Sheets

UNDERVOLTAGE RELEASE AND CIRCUIT BREAKER INCORPORATING SAME

CROSS REFERENCE TO RELATED APPLICATION

This application claims the benefit of U.S. Provisional Patent Application Ser. No. 60/615,095, filed Oct. 1, 2004.

BACKGROUND OF THE INVENTION

1. Field of the Invention

This invention relates to circuit breakers and, more particularly, to circuit breakers with mechanism that trip the circuit breaker when voltage in the protected circuit drops below a specified value.

2. Background Information

Circuit breakers primarily provide protection from excessive current in an electric power distribution system. Some circuit breakers additionally provide protection against low voltage that could damage equipment in the protected circuit. Typically, low voltage protection is provided by an undervoltage release (UVR) that includes a coil energized by the protected circuit. As long as the voltage remains above a dropout level, the magnetic force generated by the coil is sufficient to maintain a plunger in a retracted position. However, when the voltage drops below the specified value, a compression spring overcomes the magnetic force and extends the plunger out of the coil to actuate the trip mechanism of the circuit breaker. The magnetic force generated by the coil is not sufficient to retract the plunger against the bias of the compression spring even if it returns to full value. Consequently, a reset lever is provided to mechanically retract the plunger. It is known to actuate the reset lever when the handle of the circuit breaker is returned to the off position. A pin on the handle arm directly contacts the reset lever on the overvoltage relay as the handle reaches the off position. However, the handle needs to be moved beyond the off position to reset the circuit breaker operating mechanism. This results in overtravel of the pin on the handle arm.

In the past, this problem has been addressed by relying on the undervoltage relay to absorb any overtravel. Unfortunately, with variations in tolerances, excessive stress may occur on the undervoltage relay, and its functionality may be compromised.

There is room, therefore, for improvement in undervoltage release mechanisms for circuit breakers. There is also room for improvement in circuit breakers employing undervoltage release mechanisms.

SUMMARY OF THE INVENTION

In accordance with aspects of the invention, an interface lever that is at least partially compliant is provided to couple a handle arm pin on a circuit breaker handle arm to a reset lever on an undervoltage relay to accommodate for overtravel of the handle arm pin and stackup of tolerances.

As one aspect of the invention, an undervoltage release mechanism is for a circuit breaker including a handle arm rotatable through an arc between an on position, an off position, and a reset position beyond the off position. The undervoltage release mechanism comprises: a handle arm pin structured to project laterally from the handle arm out of the plane of the arc through which the handle arm rotates; an undervoltage relay comprising a plunger that is extended to a trip position when voltage in a protected circuit drops below a specified value, and a reset lever that retracts the plunger when actuated; and an interface lever between the handle arm pin and the reset lever, the interface lever structured to translate arcuate movement of the handle arm pin as the handle arm moves to the off position into actuation of the reset lever, the interface lever being formed at least partially of a compliant material that flexes to accommodate for overtravel of the handle arm pin and stackup of tolerances.

The interface lever may include a first portion that is structured for engagement by the handle arm pin and a second portion that engages the reset lever.

At least one of the first and second portions of the interface lever may be made of the compliant material.

The interface lever may be integrally molded of the compliant material.

The interface lever may include an actuating member. When the handle arm is moved to the off position, the actuating member of the interface lever may be structured for engagement by the handle arm pin to rotate the interface lever, in order to rotate the reset lever to reset the undervoltage relay. The actuating member may be tapered to further accommodate for the overtravel of the handle arm pin and stackup of tolerances.

The interface lever may include a first axis of rotation, and the reset lever may include a different second axis of rotation. The first axis of rotation may be normal to the different second axis of rotation.

As another aspect of the invention, a circuit breaker comprises: a housing; separable contacts; an operating mechanism structured to open and close the separable contacts, the operating mechanism comprising a handle arm rotatable through an arc between an on position, an off position, and a reset position beyond the off position; and an undervoltage release mechanism comprising: a handle arm pin projecting laterally from the handle arm out of the plane of the arc through which the handle arm rotates, an undervoltage relay comprising a plunger that is extended to a trip position when voltage in a protected circuit drops below a specified value, and a reset lever that retracts the plunger when actuated, and an interface lever between the handle arm pin and the reset lever translating arcuate movement of the handle arm pin as the handle arm moves to the off position into actuation of the reset lever, the interface lever being formed at least partially of a compliant material that flexes to accommodate for overtravel of the handle arm pin and stackup of tolerances.

As another aspect of the invention, a circuit breaker comprises: a housing; separable contacts; an operating mechanism structured to open and close the separable contacts, the operating mechanism comprising a handle arm rotatable through an arc between an on position, an off position, and a reset position beyond the off position; a trip mechanism cooperating with the operating mechanism to trip open the separable contacts; and an undervoltage release mechanism comprising: a handle arm pin projecting laterally from the handle arm out of the plane of the arc through which the handle arm rotates, an undervoltage relay comprising a plunger that is extended to a trip position when voltage in a protected circuit drops below a specified value, and a reset lever that retracts the plunger when actuated, and an interface lever between the handle arm pin and the reset lever translating arcuate movement of the handle arm pin as the handle arm moves to the off position into actuation of the reset lever, the interface lever being formed at least partially of a compliant material that flexes to accommodate for overtravel of the handle arm pin and stackup of tolerances.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
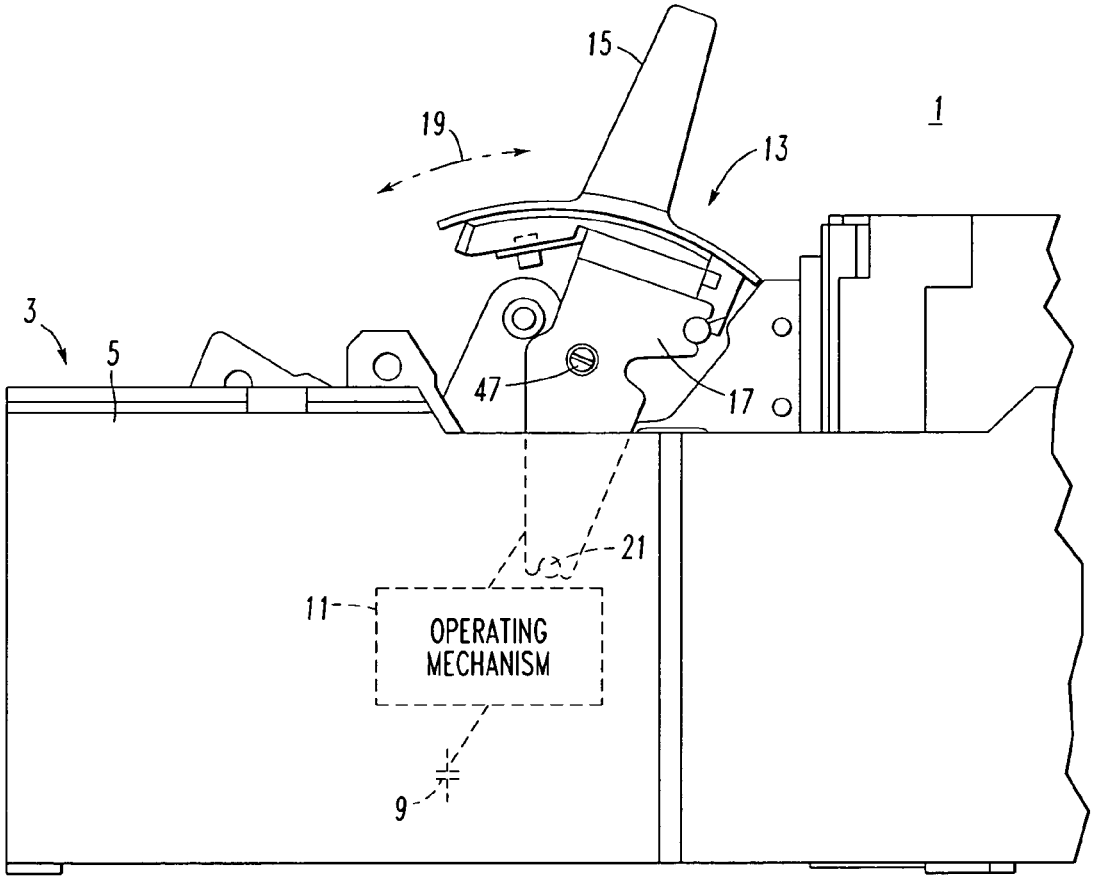
FIG. 1 is a side elevation view of a circuit breaker incorporating the invention with the cover removed.
Figure 3:
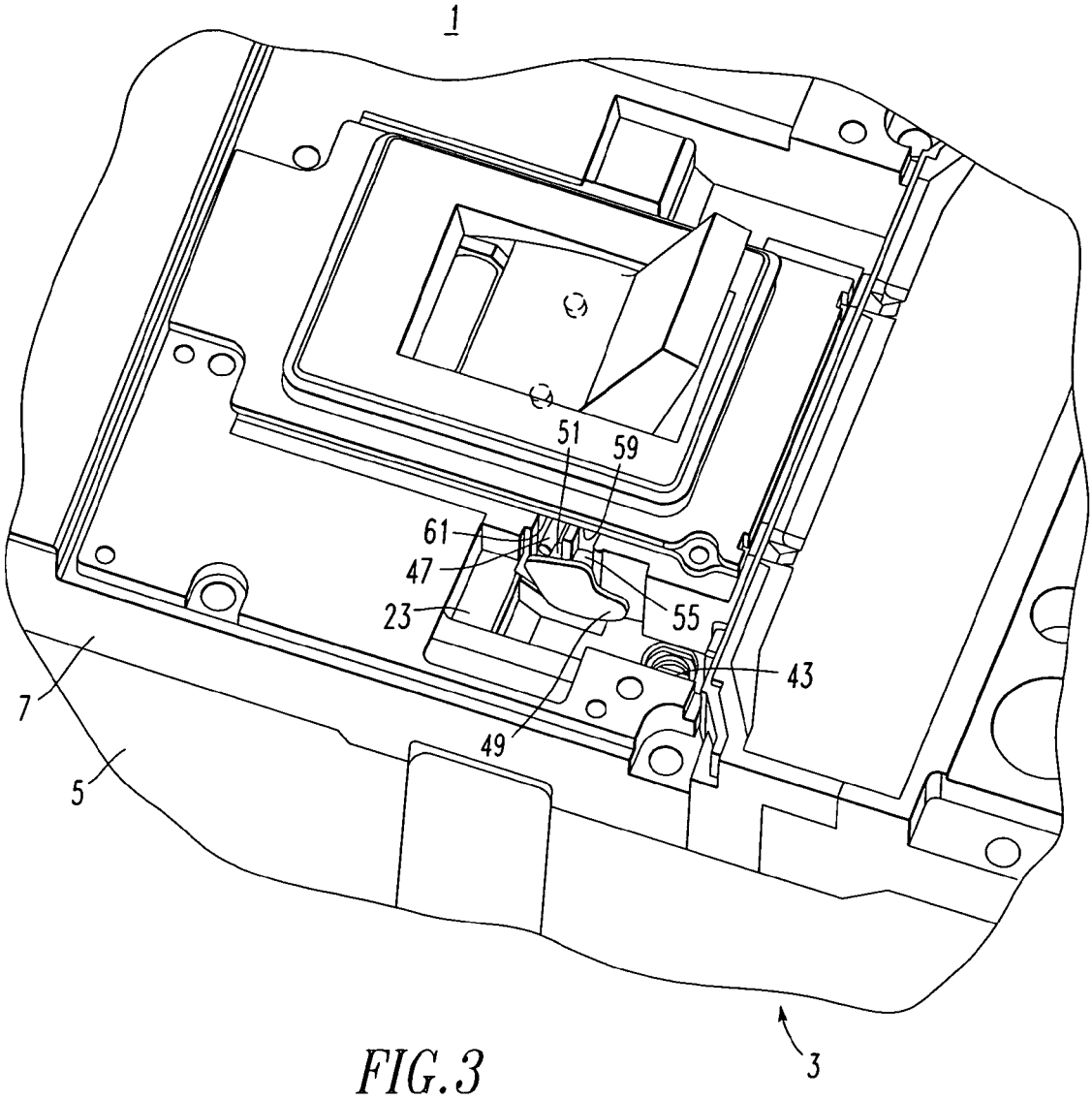
FIG. 3 is a fractional isometric view from above the circuit breaker illustrating the position of the interface lever within the circuit breaker housing.
Figure 5:
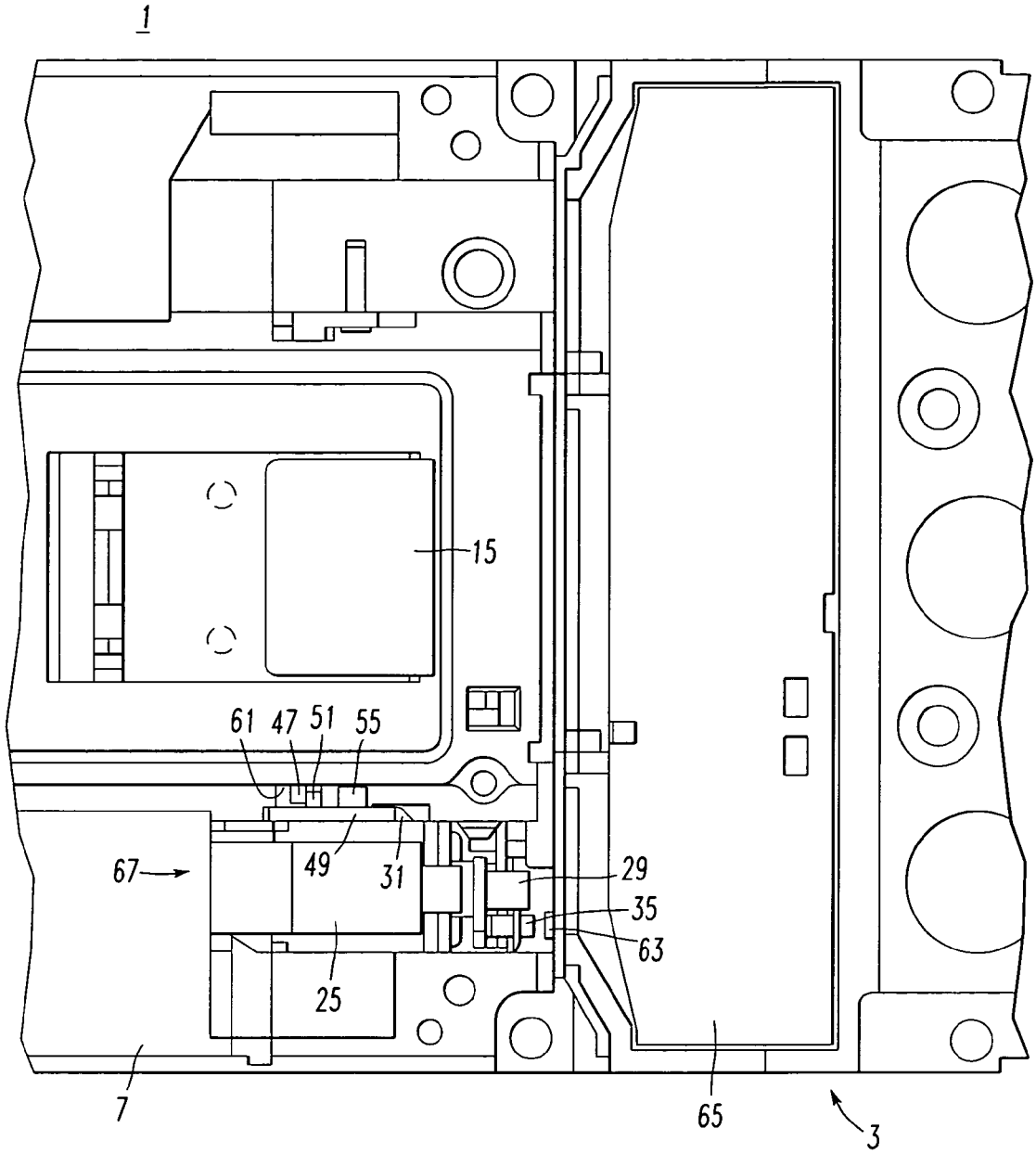
FIG. 5 is a top plan view of the circuit breaker with the undervoltage relay mechanism installed.

Referring to FIGS. 1, 3 and 5, a circuit breaker 1 incorporating aspects of the invention, has a housing 3 formed by a base 5 and primary cover 7 as shown in FIG. 3. Such a circuit breaker 1 has separable contacts 9 that are opened and closed by an operating mechanism 11. The operating mechanism 11 can be operated manually by an operating member 13 to open and close the separable contacts 9. The operating member includes a handle 15 mounted on a handle arm 17 that is rotatable as shown by the arrows 19 about a pivot axis 21 between an off position, as shown in FIGS. 1, 3 and 5, and an on position in which the handle 15 is rotated counterclockwise (with respect to FIG. 1) from the position shown. The operating member 13 can be rotated further clockwise to a reset position (not shown) to reset the operating mechanism 11 after a trip, all as is well known.

The primary cover 7 has a compartment 23 in which accessories can be installed (see FIG. 3). This compartment 23 is enclosed by a removable secondary cover (not shown) that seats on the primary cover 7.

Figure 2:
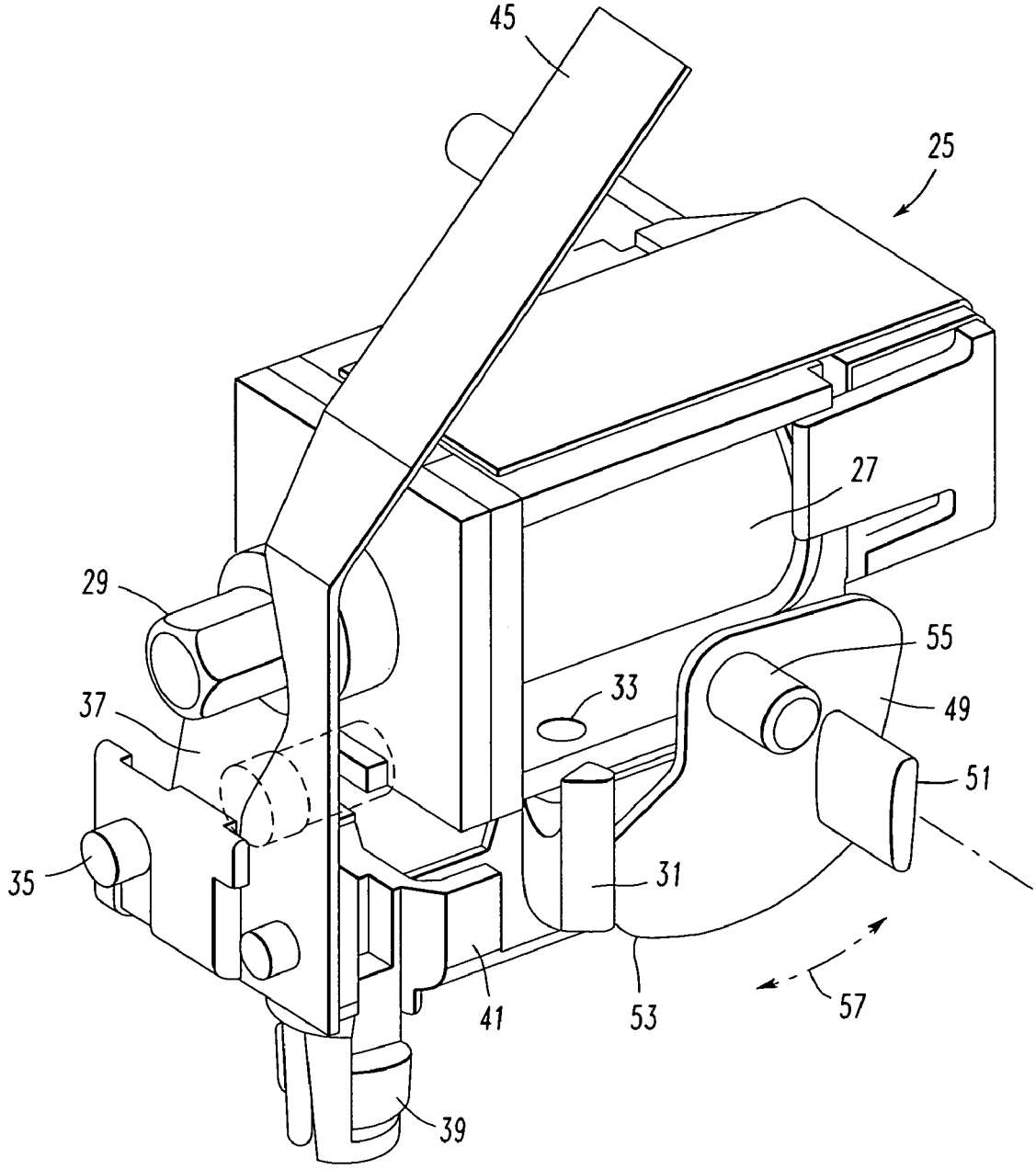
FIG. 2 is an isometric view of the undervoltage relay and its engagement by an interface lever which forms part of the undervoltage release mechanism.

One of the accessories that can be installed in the compartment 23 is an undervoltage relay 25, which is best seen in FIG. 2. Such an undervoltage relay 25 is known, and has a coil 27 and a plunger 29. The coil spring (not visible in FIG. 2) biases the plunger 29 to an extended or actuated position. A reset lever 31 that rotates about an axis 33 mechanically retracts the plunger 29 against the bias of the spring. With the plunger 29 retracted, energization of the coil 27 generates a magnetic force sufficient to hold the plunger in against the bias of the spring. The coil is energized by the line voltage. If this line voltage falls below a target value, the weakened magnetic force is overcome by the spring and the plunger 29 is actuated (extended). An offset plunger 35 is carried by the plunger 29 through an offset bracket 37. The offset plunger 35 is available to register with a trip mechanism, such as trip unit 65 (FIG. 5), that is not aligned with the main plunger 29. A clamp 39 integrally molded with a housing 41 of the undervoltage relay 25 engages a recess 43 (see FIG. 3) to secure the undervoltage relay 25 in the compartment 23. A flexible pull tab 45 is used to disengage the clamp 39 for removal of the undervoltage relay 25 from the circuit breaker 1.

Figure 4:
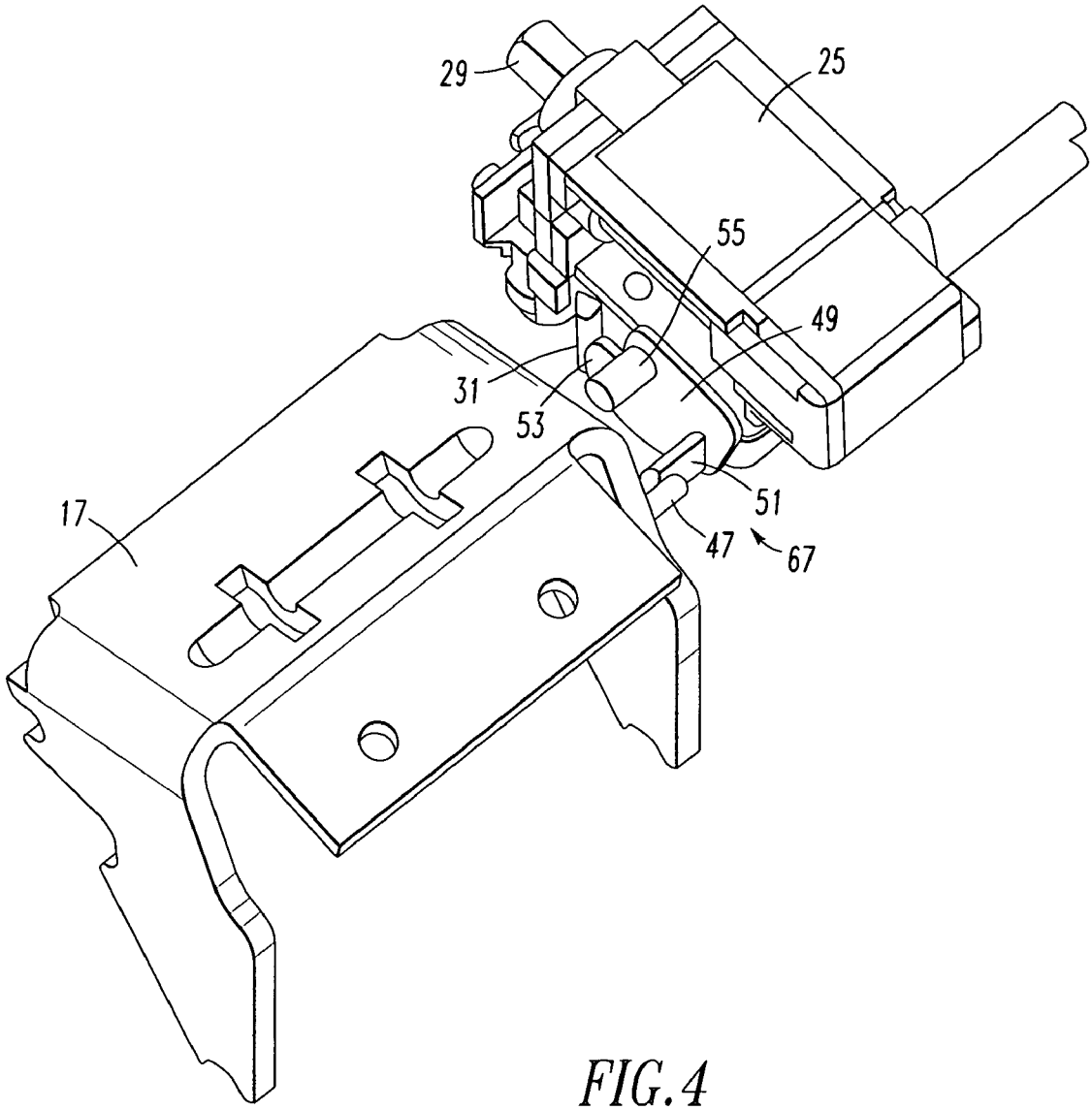
FIG. 4 is an isometric view illustrating the coupling of the handle arm to the undervoltage relay by the interface lever.

The undervoltage relay 25 is reset by movement of the operating member 13 through the handle 15 to the off position. To this end, a handle arm pin 47 (FIG. 4) projects laterally out of the plane of rotation of the handle arm 17, and therefore, rotates through the arc depicted by the arrows 19 (FIG. 1). This arcuate movement of the handle arm pin 47 is translated into rotation of the reset lever 31 on the undervoltage relay 25 by an interface lever 49. The interface lever 49 has a first portion 51 that is engaged by the handle arm pin 47 and a second portion 53 that engages the reset lever 31. A pivot pin 55 supports the interface lever 49 for arcuate rotation as indicated by the arrows 57.

As best seen in FIG. 3, the pivot pin 55 on the interface lever 49 seats in a slot 59 in the compartment 23 of the primary cover 7. The first portion, which in the exemplary embodiment is in the form of an actuating arm 51, extends through an opening 61 in the cover 7 where it can be engaged by the handle arm pin 47, as can also be seen in FIG. 3. As also shown in FIG. 5, when the overvoltage relay detects an undervoltage condition, the plunger 29, and therefore the offset plunger 35, extend so that the latter actuates a trip button 63 on the trip unit 65 of the circuit breaker 1. This causes the handle 15 and handle arm 17 to move to a trip position, which as is common practice, is between the on and off positions.

When the handle 15 is manually moved to the off position, the handle arm pin 47 engages the actuating arm 51 on the interface lever 49 to rotate and thereby rotate the reset lever 31 to reset the undervoltage relay 25. To reset the circuit breaker operating mechanism 11, the handle 15 and handle arm 17 are moved clockwise, as seen in FIG. 1, past the off position. In order to accommodate for this overtravel and for tolerances that affect the coupling between the handle arm pin 47 and the reset lever 31, the interface lever 49 is provided with compliance that allows it to flex. This flexure could be localized, such as in the actuating arm 51 and/or the second portion 53; however, the exemplary interface lever 49 is integrally molded of a compliant material, such as, for instance, nylon that permits it to flex. In particular, the actuating arm 51 can be tapered as shown to provide the desired flexure. The compliance of the interface lever 49 is such that it is stiff enough to transmit the necessary force from the handle arm pin 47 to the reset lever 31 to reset the undervoltage relay 25, but to then flex during overtravel of the handle arm pin 47 without applying undue force to the reset lever 31. The undervoltage relay 25, the handle arm pin 47, and the interface lever 49 form an undervoltage release mechanism 67 that provides reliable resetting of the undervoltage relay 25, yet accommodates for overtravel and the stackup of tolerances without applying undue force to the undervoltage relay 25.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An undervoltage release mechanism for a circuit breaker including a handle arm rotatable through an arc between an on position, an off position, and a reset position beyond the off position, said undervoltage release mechanism comprising:

a handle arm pin structured to project laterally from the handle arm out of the plane of the arc through which the handle arm rotates;

an undervoltage relay comprising a plunger that is extended to a trip position when voltage in a protected circuit drops below a specified value, and a reset lever that retracts the plunger when actuated; and an interface lever between the handle arm pin and the reset lever, said interface lever structured to translate arcuate movement of the handle arm pin as the handle arm moves to the off position into actuation of the reset lever, the interface lever being formed at least partially of a compliant material that flexes to accommodate for overtravel of the handle arm pin and stackup of tolerances.

2. The undervoltage release mechanism of claim 1 wherein said interface lever includes a first portion that is structured for engagement by the handle arm pin and a second portion that engages the reset lever.

3. The undervoltage release mechanism of claim 2 wherein at least one of the first and second portions of said interface lever is made of said compliant material.

4. The undervoltage release mechanism of claim 1 wherein said interface lever is integrally molded of said compliant material.

5. The undervoltage release mechanism of claim 1 wherein said compliant material is nylon.

6. The undervoltage release mechanism of claim 1 wherein said interface lever includes an actuating member; and wherein when said handle arm is moved to the off position, the actuating member of said interface lever is structured for engagement by the handle arm pin to rotate said interface lever, in order to rotate said reset lever to reset said undervoltage relay.

7. The undervoltage release mechanism of claim 6 wherein said actuating member is tapered to further accommodate for said overtravel of the handle arm pin and stackup of tolerances.

8. The undervoltage release mechanism of claim 1 wherein said interface lever includes a first axis of rotation; and wherein said reset lever includes a different second axis of rotation.

9. The undervoltage release mechanism of claim 8 wherein said first axis of rotation is normal to said different second axis of rotation.

10. A circuit breaker comprising:

a housing;

separable contacts;

an operating mechanism structured to open and close said separable contacts, said operating mechanism comprising a handle arm rotatable through an arc between an on position, an off position, and a reset position beyond the off position; and an undervoltage release mechanism comprising:

a handle arm pin projecting laterally from the handle arm out of the plane of the arc through which the handle arm rotates, an undervoltage relay comprising a plunger that is extended to a trip position when voltage in a protected circuit drops below a specified value, and a reset lever that retracts the plunger when actuated, and an interface lever between the handle arm pin and the reset lever translating arcuate movement of the handle arm pin as the handle arm moves to the off position into actuation of the reset lever, the interface lever being formed at least partially of a compliant material that flexes to accommodate for overtravel of the handle arm pin and stackup of tolerances.

11. The circuit breaker of claim 10 wherein said interface lever includes a first portion that is engaged by the handle arm pin and a second portion that engages the reset lever.

12. The circuit breaker of claim 11 wherein at least one of the first and second portions is made of said compliant material.

13. The circuit breaker of claim 11 wherein said housing comprises a base and a cover including an opening; and wherein said first portion is an actuating arm extending through the opening of said cover for engagement by said handle arm pin.

14. The circuit breaker of claim 10 wherein said interface lever is integrally molded of said compliant material.

15. The circuit breaker of claim 10 wherein said interface lever includes a pivot pin engaging said housing and supporting said interface lever for arcuate rotation.

16. The circuit breaker of claim 15 wherein said housing comprises a base and a primary cover including a compartment having a slot; and wherein said pivot pin rests in the slot of the compartment of said primary cover.

17. The circuit breaker of claim 10 wherein said interface lever includes an actuating member; and wherein when said handle arm is moved to the off position, the handle arm pin engages the actuating member of said interface lever to rotate said interface lever, in order to rotate said reset lever to reset said undervoltage relay.

18. The circuit breaker of claim 17 wherein said actuating member is tapered to further accommodate for said overtravel of the handle arm pin and stackup of tolerances.

19. A circuit breaker comprising:

a housing;

separable contacts;

an operating mechanism structured to open and close said separable contacts, said operating mechanism comprising a handle arm rotatable through an arc between an on position, an off position, and a reset position beyond the off position;

a trip mechanism cooperating with said operating mechanism to trip open said separable contacts; and an undervoltage release mechanism comprising:

a handle arm pin projecting laterally from the handle arm out of the plane of the arc through which the handle arm rotates, an undervoltage relay comprising a plunger that is extended to a trip position when voltage in a protected circuit drops below a specified value, and a reset lever that retracts the plunger when actuated, and an interface lever between the handle arm pin and the reset lever translating arcuate movement of the handle arm pin as the handle arm moves to the off position into actuation of the reset lever, the interface lever being formed at least partially of a compliant material that flexes to accommodate for overtravel of the handle arm pin and stackup of tolerances.

20. The circuit breaker of claim 19 wherein the plunger of said undervoltage relay carries an offset plunger; and wherein when said overvoltage relay detects an undervoltage condition, said plunger and said offset plunger extend in order that said offset plunger actuates said trip mechanism to trip open said separable contacts.

* * * * *